United States Patent [19]

Mace

[11] Patent Number: 4,702,025

[45] Date of Patent: Oct. 27, 1987

[54] DISPLAY FRAME

[75] Inventor: Vincent Mace, Springfield, Pa.

[73] Assignee: M & M Displays, Philadelphia, Pa.

[21] Appl. No.: 801,638

[22] Filed: Nov. 25, 1985

[51] Int. Cl.[4] ..... G09F 1/12

[52] U.S. Cl. ..... 40/156; 40/13; 40/152.1

[58] Field of Search ..... 40/13, 152.1, 152, 156, 40/10

[56] References Cited

U.S. PATENT DOCUMENTS

| | | | |
|---|---|---|---|
| 2,882,633 | 4/1959 | Howell | 40/13 |
| 3,205,601 | 9/1965 | Gawne et al. | 40/13 |
| 3,310,901 | 3/1967 | Sarkisian | 40/13 |
| 3,955,298 | 5/1976 | Kapstad | 40/152 |
| 4,145,828 | 3/1979 | Hillstrom | 40/156 |
| 4,519,152 | 5/1985 | Seely et al. | 40/13 |

*Primary Examiner*—John J. Wilson
*Assistant Examiner*—Wenceslao J. Contreras
*Attorney, Agent, or Firm*—Benasutti & Murray

[57] ABSTRACT

A display frame for a sign, poster, or the like. The frame comprises a plurality of frame sections each comprising a rear structure, a front structure, and tensioned spring means. The rear structure has a cylindrically shaped portion and an opposing channel spaced therefrom, while the front structure comprises a forward panel portion and a semi-circularly shaped portion, and with the latter being rotatably mounted on the cylindrical portion of the rear structure to thereby permit movement of the front structure from an open to a closed position. A spring means is disposed between the channel and the cylindrical portion of the rear structure, with the end thereof adjacent the cylindrical portion being circularly shaped. Said end biases against the leading edge of the semi-circularly shaped portion of the front structure when said structure is in the closed position, and against the solid section of the semi-circular portion when the front structure is moved toward or maintained at the open position. When the spring means is biased against said solid section, this front structure can be selectively moved to or maintained at any intermediate site of travel.

12 Claims, 4 Drawing Figures

FIG. 1
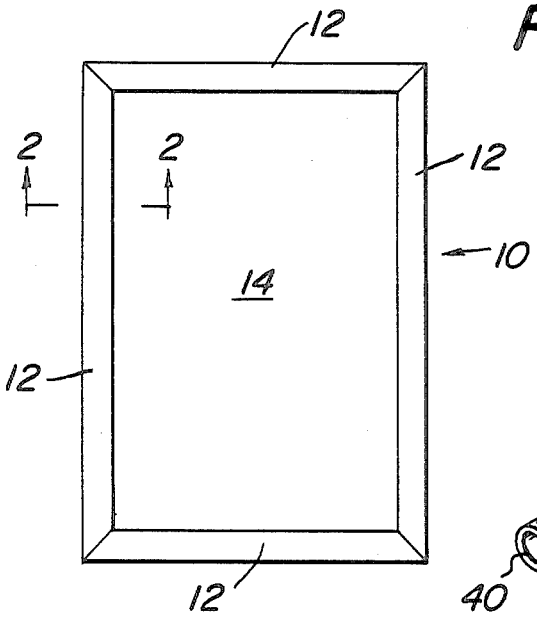
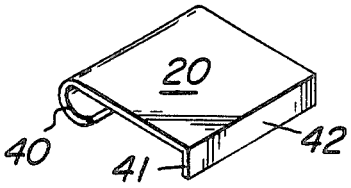
FIG. 4
FIG. 2
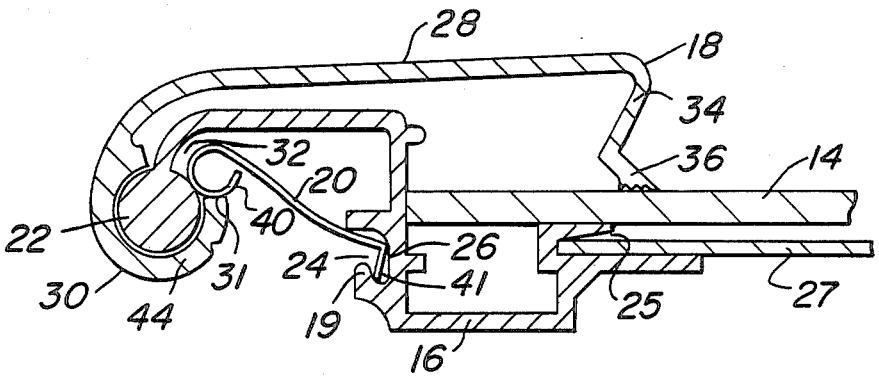

DISPLAY FRAME

BACKGROUND OF THE INVENTION

This invention relates to a display frame for signs, posters, and the like, and in particular to a frame whose members can be selectively spring biased closed to retain a display therein or selectively opened at infinite intermediate sites for removal therefrom of a display.

There are numerous uses for display frames whose displayed material there housed is changed on a regular schedule. A primary example of such use is that of signs displayed by merchants in order to advertise the availability and/or price of certain merchandise. Because such signs bear information which changes, the merchant must replace the signs with new ones that convey new information.

Because of the need to constantly change displayed material, it is desirable that such material be easily and conveniently placed within and removed from its frame. One approach for accomplishing this goal is to provide a frame structure whose members open outwardly to thereby release material retained therein and to permit insertion of new material for subsequent retention which is accomplished by closing the frame members. U.S. Pat. No. 4,145,828 describes a frame whose sides pivot outwardly and incorporate leaf type springs which bias the frame sides in a fully open or completely closed configuration. The frame does not provide for intermediate stopping or retention positions to thereby alleviate high velocity movement from an open to a closed position. The present invention, however, does provide a display frame whose members have a biasing force in a closed position and a retaining force in an open position as well as in intermediate positions between the open and closed configurations.

SUMMARY OF THE INVENTION

It is a primary object of this invention to provide a display frame whose members open outwardly and have a biasing force in a closed position as well as a retaining force in an open position and in intermediate positions between the open and closed configurations.

Another object of the invention is to provide a display frame whose members retain under tension displayed material therein.

Yet another object of the invention is to provide tensioned spring means to frame members which cooperate with said frame members to permit controllable velocity to the opening and closing of such frame members.

A further object of the invention is to provide a frame member having a rear structure and a front structure cooperating in tension relationship to each other and each being of one piece construction.

These and other objects of the invention will become apparent throughout the description thereof which follows.

Accordingly, the subject of the instant invention is a display frame comprising a plurality of frame sections whose adjacent ends are joined to each other. Each of the frame sections comprises a rear structure, a front structure, and tensioned spring means.

The rear structure of the frame section comprises a cylindrically shaped portion and a spring receiving means disposed in opposed relationship to the cylindrically shaped portion and spaced therefrom.

The front structure of the frame section comprises a forward panel portion having disposed along one edge thereof and depending rearwardly and inwardly therefrom a semi-circularly shaped structure mounted around the cylindrically shaped portion of the rear structure and rotatably movable thereon for a distance equal to the open section of the semi-circular structure. In such manner the front structure can be moved from an open to a closed position. The open section of the semi-circularly shaped structure is disposed in opposed relationship to the spring receiving means of the rear structure when the front structure is in a closed position.

The tensioned spring means of the frame member has a circularly shaped end thereof disposed within the open section of the semi-circularly shaped structure of the front structure and biased against the leading edge of said semi-circularly shaped structure when the front structure is closed. The spring means has an opposite end thereof which is disposed within the spring receiving means of the rear structure.

When the front structure is closed, it is biased in this position and against the border of displayed material because of the force applied by the circularly shaped end of the spring means against the leading edge of the semi-circularly shaped structure. Upon rotating the front structure to open the frame, the circularly shaped end of the spring means becomes dislodged from the open section of the semi-circular structure to thereafter be disposed against the solid section of said semi-circular structure. While it is so disposed, the front structure can be selectively rotated on the cylindrically shaped portion of the rear structure and retainably stopped there along as desired.

BRIEF DESCRIPTION OF THE DRAWINGS

FIG. 1 is an elevation view of a display frame;

FIG. 2 is a sectional view of a frame member along lines 2—2 of FIG. 1;

FIG. 4 is a perspective view of spring means.

DETAILED DESCRIPTION OF A PREFERRED EMBODIMENT

Figure 3:
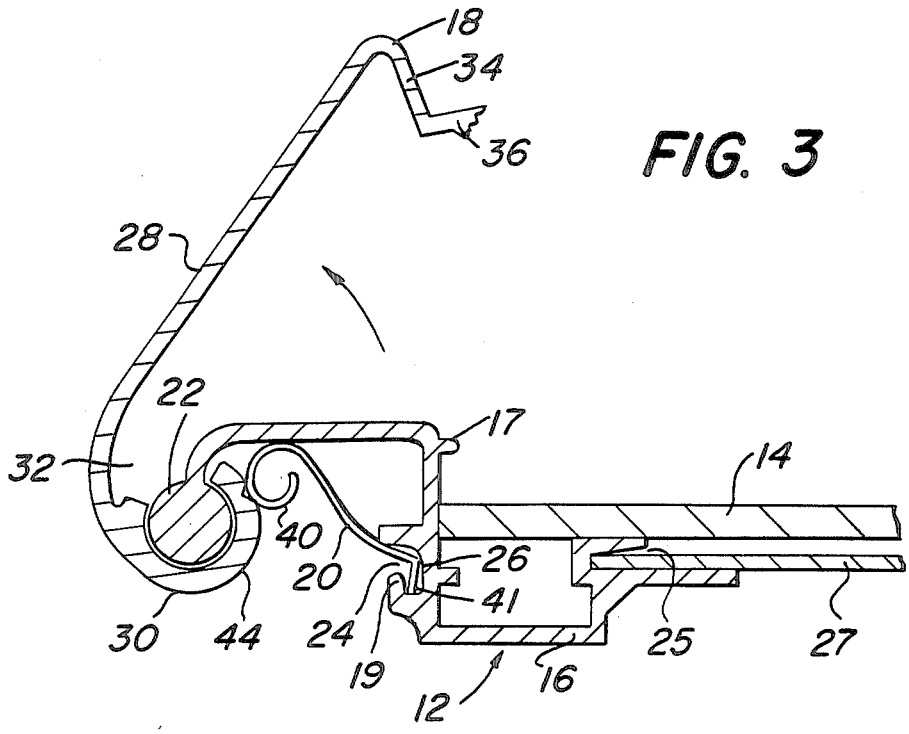
FIG. 3 is a sectional view of the frame member of FIG. 2 in an open configuration.

Referring to FIG. 1, a display frame 10 is illustrated. The frame 10 is comprised of a plurality of frame sections 12 which are joined at their respective adjacent ends by connecting brackets (not shown) as known in the art. Within the border of the frame section 12 a display 14 such as a sign, poster, or the like can reside.

As illustrated in FIGS. 2 and 3, a frame section 12 comprises a rear structure 16, a front structure 18 and a tensioned spring means 20. The rear structure 16 comprises a cylindrically shaped portion 22 which extends for essentially the entire length of said rear structure 16. Spaced from the portion 22 is a lipped first channel 24 whose open portion is disposed in opposed relationship to the portion 22. The first channel 24 likewise extends for essentially the entire length of the rear structure 16. In the embodiment here shown, the floor 26 of the channel 24 is flat. The rear structure 16 additionally has an inwardly disposed second channel 25 spaced from the first channel 24 and having its open portion disposed in a direction opposite to the open portion of said first channel 24. This second channel 25 receives the border of a backboard 27 housed in the frame 10 to thereby close the back thereof. Display positioning means here comprising an inwardly projecting border member 17 permits positive positioning of the display 14. The rear structure 16 is of one piece aluminum construction extruded as known in the art.

The front structure 18 of the frame section 12 comprises a forward panel portion 28 having disposed along one edge thereof for essentially the entire length thereof a semi-circularly shaped structure 30 which depends rearwardly and inwardly from the panel portion 28. The open portion 32 of the semi-circularly shaped structure 30 is about 90°. Said structure 30 is mounted around the cylindrical portion 22 of the rear structure 16, and is rotatably movable thereon for said 90° to thereby permit opening and closing of the front structure 18. FIGS. 2 and 3 illustrate such 90° rotatable movement. Along the opposite edge of the panel portion 28 for essentially the entire length thereof and depending rearwardly therefrom is a display retention means 34 here comprising an extension of the forward panel 28. The leading edge 36 of the retention means 34 abuts displayed material residing in the frame 10 when the front structure 18 is in a biased closed position as shown in FIG. 2 to thereby retain such material. The front structure 18 is of one piece aluminum construction extruded as known in the art.

The tensioned spring means 20 as illustrated in FIGS. 2–4 here comprises a strip of material capable of such tensionability as would be recognized by the skilled artisan. In the embodiment here illustrated, a three ounce, spring tempered stainless steel material is employed. One end 40 of the spring means is circularly shaped and is disposed within the open section 32 of the semi-circularly shaped structure of the front structure 18 when said front structure 18 is in a closed position as shown in FIG. 2. In this closed configuration, the circularly shaped end 40 biases closed said front structure 18 with tensioned force against the leading edge 31 of the semi-circularly shaped structure 30 thereof. The other end 41 of the spring means 20 resides within the channel 24, and is shaped to have a flat portion 42 which is shaped to be adjacent to the flat floor in said channel 24. The lip 19 of the channel 24 functions to retain the end 41 of the spring means 20 within said channel 24.

When the front structure is rotated and thereby opened as shown in FIG. 3, the circularly shaped end 40 of the spring means 20 is dislodged from the open section 32 of the semi-circularly shaped structure 30, and is thereafter disposed against the solid section 44 thereof. The other end of the spring means 20 continues to reside in the channel 24. The spring means 20 continues to be under tension, of course, and thereby exerts its force on said solid section 44. In such manner, the front structure 18 can be selectively rotated at any velocity desired, and will be retained by the force of the spring means against said solid section 44 at any stopping point.

In operation of this preferred embodiment, the front structures 18 of all frame sections 12 are opened, and a display such as a sign or poster is positioned within the frame 10. After such placement, a user closes each front structure 18, and the display is thereby housed and retained. To remove the display, the above steps are reversed. As earlier related, the velocity of both the opening and closing of the front structure 18 is totally controllable by a user, thereby eliminating the "snapping closed" of such front structure 18 and any injury to the user which such action may cause. Likewise, the front structure 18 can be stopped along its opening or closing path and there retained by the spring means 20 when its end 40 is disposed against the solid section 44 of the semi-circularly shaped structure 30 of the front structure 18 as earlier described. The display frame 10 thus provides a convenient and safe means wherein display material can be housed.

It is to be understood that the above description of a preferred embodiment is meant to be illustrative and not limiting, and that the scope of the invention is defined in the claims which follow.

What is claimed is:

1. A display frame for holding a sign, poster, or the like, said frame comprising a plurality of frame sections whose adjacent ends are joined to each other to form a polygonal shape, with each of said frame sections comprising:

(a) a first rear structure comprising a cylindrically shaped portion and a spring receiving means spaced therefrom on said rear structure, facing said cylindrically shaped portion;

(b) a second front structure comprising a first forward panel portion having disposed along a first edge thereof and depending therefrom a semi-circularly shaped structure adapted for mounting in orientation around said cylindrically shaped portion of said cylindrically shaped portion of said first rear structure and pivotally movable thereon over a predetermined arc between fully open and fully closed positions, whereby the open section of said semi-circularly shaped structure is disposed facing said spring receiving means of said first rear structure when said second front structure is in said closed position; and (c) tensioned spring means having a first end disposed within the spring receiving means of said first rear structure and having a circularly shaped second end disposed within the open section of said semi-circularly shaped structure and biased against a leading edge of said semi-circularly shaped structure when said second front structure is in a closed position, and biased against a solid section of said semi-circularly shaped structure for at least a substantial portion of said predetermined arc of pivotal travel of said second structure when said second front structure is not in a closed position

2. A display frame as claimed in claim 1 wherein the first rear structure additionally comprises an inwardly disposed channel wherein the border of a backboard can reside.

3. A display frame as claimed in claim 1 wherein the first rear structure additionally comprises display positioning means.

4. A display frame as claimed in claim 1 wherein said first forward panel portion of said second front structure has disposed along a second edge opposite said first edge and depending therefrom in the same direction as said semi-circularly shaped structure an extension thereof having a leading edge adapted to abuts a display housed within the frame when said second front structure is in a closed position.

5. A display frame as claimed in claim 1 wherein said open section of said semi-circularly shaped portion of said second front structure extends circumferentially about 90°.

6. A display frame as claimed in claim 1 wherein said spring receiving means on said first rear structure is a lipped channel

7. A display frame as claimed in claim 6 wherein said lipped channel has a flat floor and wherein a portion of the first end of the spring means is shaped to be adjacent to said flat floor.

8. A display frame as claimed in claim 1 wherein said first rear structure is of one piece construction.

9. A display frame as claimed in claim 8 wherein said second front structure is of one piece construction.

10. A display frame as claimed in claim 1 wherein said second front structure is of one piece construction.

11. A display frame as claimed in claim 1 wherein opposing frame sections are parallel to each other.

12. A display frame as claimed in claim 11 whose shape is rectangular.

* * * * *